US005566402A

United States Patent [19]

Agha el-Rifai et al.

[11] Patent Number: 5,566,402

[45] Date of Patent: Oct. 22, 1996

[54] BIDET APPARATUS FOR TOILETS

[75] Inventors: Mohammed T. S. Agha el-Rifai, Niagara-on-the-Lake; Ian F. Norton, Toronto, both of Canada

[73] Assignee: Rim Innovation and Marketing Consultants Inc., St. Catharines, Canada

[21] Appl. No.: 403,940

[22] Filed: Mar. 14, 1995

[51] Int. Cl.[6] ..... A47K 3/22

[52] U.S. Cl. ..... 4/420.4

[58] Field of Search ..... 4/420.1–420.5, 4/447

[56] References Cited

U.S. PATENT DOCUMENTS

| | | | |
|---|---|---|---|
| 1,521,892 | 6/1925 | Koppin | 4/420.4 |
| 1,663,111 | 3/1928 | Campus | 4/420.5 |
| 1,855,008 | 4/1932 | Callejo | 4/420.5 |
| 2,427,953 | 9/1947 | Fishko . | |
| 2,852,782 | 9/1958 | Sundberg | 4/420.4 |
| 4,304,016 | 12/1981 | Oguma et al. | 4/420.2 |
| 4,334,329 | 6/1982 | Miyanaga | 4/443 |
| 4,370,764 | 2/1983 | Ando et al. | 4/443 |
| 4,389,738 | 6/1983 | Ando et al. | 4/420.2 |
| 4,558,473 | 12/1985 | Morikawa et al. | 4/420.4 |
| 4,597,111 | 7/1986 | Hirashiba et al. | 4/420.4 |
| 4,598,431 | 7/1986 | Nagai et al. | 4/443 |
| 4,616,368 | 10/1986 | Nagai et al. | 4/420.2 |
| 4,642,820 | 2/1987 | Boring, Jr. | 4/448 |
| 4,670,917 | 6/1987 | Kuo | 4/443 |
| 4,829,606 | 5/1989 | Hirashiba et al. | 4/420.4 |
| 4,876,750 | 10/1989 | Broyles | 4/420.4 |

FOREIGN PATENT DOCUMENTS

| | | | |
|---|---|---|---|
| 2142054 | 1/1985 | United Kingdom | 4/420 |

*Primary Examiner*—Charles E. Phillips
*Attorney, Agent, or Firm*—Armstrong & Pilo

[57] ABSTRACT

The bidet is installed as an addition to a conventional toilet bowl having a hinged seat and lid. A nozzle arm is pivotable from an at-rest position, where the nozzle is tucked away unobtrusively under the toilet seat near the rim of the toilet bowl, to an operative spray position in which the nozzle is positioned centrally, to direct a gentle spray of water upwards at the underbody premises of a person sitting on the toilet bowl. Rotation of the lever arm causes a cam to push a spring-loaded plunger open, to produce a flow of water from a supply line, to the nozzle. When the toilet seat is raised, a spring raises the bidet assembly along with the seat, not only keeping it out of the way for male urination, but also facilitating cleaning of the toilet bowl.

2 Claims, 6 Drawing Sheets

BIDET APPARATUS FOR TOILETS

BACKGROUND OF THE INVENTION

1. Field of the Invention

This invention relates to a bidet apparatus which may be fitted to and combined with a conventional toilet bowl and seat.

When a bidet apparatus is to be combined with a toilet bowl, one of the factors the designer should bear in mind is that the function of the toilet itself is not to be impaired. It is therefore desirable, in a toilet-combination bidet apparatus, that the spray nozzle, and indeed all of the components of the bidet apparatus, should be so positioned, when the bidet apparatus is not in operation, that the spray nozzle and the other components lie out of the way of both liquid and solid excrement falling into the toilet bowl.

As a result of this requirement, a conventional toilet-combination bidet apparatus will generally include a means whereby the spray nozzle is movable between a rest position and an operating, i.e. spray, position. Generally, in a conventional toilet-combination bidet apparatus, the designer mounts the nozzle upon a nozzle arm, and provides that the nozzle arm swings or rotates between the rest position and the spray position.

The present invention is mainly concerned with the problems of feeding and controlling a water supply to and through a nozzle arm which is capable of moving or swinging, and is concerned also with the problems of mounting and guiding the movable components of a toilet-combination bidet apparatus strongly and firmly, so that the bidet may be expected to have a long and reliable service life.

2. Description Of The Prior Art

A number of prior art patents, of which U.S. Pat. No. 4,334,329 (Miyanaga) and British application no. 2142054A are typical, show a toilet-combination bidet apparatus, in which a nozzle arm is mounted for swinging between a rest position and an operational position.

The invention is aimed at improving this general type of combination bidet apparatus.

SUMMARY OF THE INVENTION

The toilet-combination bidet apparatus of the invention includes a nozzle arm which is tucked away unobtrusively to the side of the toilet bowl when not in use, and the nozzle arm is movable to a more central position when bidet operation is to take place. In the invention, the action of a person in causing the nozzle arm to move to the operational position is effective also to turn on the water supply to the nozzle. Equally, the action of the person in causing the nozzle arm to return from its operational position to its at-rest position is effective to turn off the water supply.

Thus, in the invention, the action of moving the nozzle arm into operation is effective simultaneously and automatically to turn on the water. Equally, returning the nozzle arm to the at-rest position is effective simultaneously and automatically to turn off the water. This is achieved by movement of a simple lever arm.

The benefits that arise from this arrangement may be described as follows. In a toilet-combination bidet, the bidet of course may be used on its own, but often use of the bidet arises only after use of the toilet; that is to say, when the person is seated upon the toilet seat. In this situation, the person finds it awkward to reach behind to operate numerous controls: in the invention, only a single control is required, and only a single actuation movement is required, i.e. operation of the lever arm, and that lever arm is readily at hand.

It is recognised also that it should not be possible for a person to turn on the water while the nozzle is in the at-rest position. A corresponding difficulty might arise, with independent operation, in that the person might turn the water off, and, thinking the bidet is therefore out of operation, might by mistake leave the bidet with the now quiescent nozzle arm still extended to its operational position.

In the invention, none of these things would happen: if the nozzle arm is out, the water is on; if the nozzle arm is away, the water is off.

In the invention, rotation of the lever arm causes a cam to push a spring-loaded plunger open, to produce a flow of water from a supply line, to the nozzle.

A further advantage of the preferred embodiment of the invention is that when the toilet seat is raised, a spring raises the bidet assembly along with the seat, not only keeping it out of the way for male urination without need for attachment to the toilet seat, but also facilitating cleaning of the toilet bowl.

BRIEF DESCRIPTION OF THE DRAWINGS

By way of further explanation of the invention, an exemplary embodiment of the invention will now be described with reference to the accompanying drawings, in which.

DETAILED DESCRIPTION OF THE PREFERRED EMBODIMENT

Figure 1:
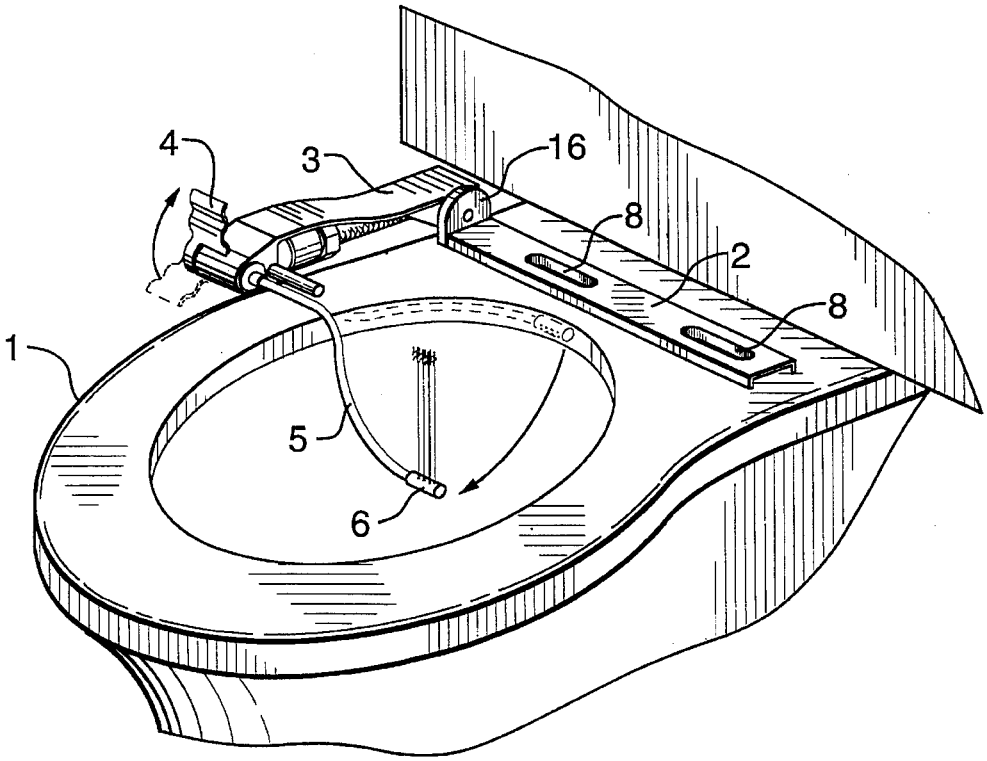
FIG. 1 is a perspective view showing the apparatus installed on a typical toilet.

FIG. 1 shows the preferred embodiment of the invention installed on a toilet bowl 1. The device includes a mounting bracket 2, a body 3 pivotally attached near one of its ends to one end of the mounting bracket, and a lever arm 4 at the distal end of the body. The lever arm operates a valve, described below, and rotates a spray arm 5 with a spray nozzle 6.

The mounting bracket 2 includes two slotted holes 8 which permit the device to be installed on a wide variety of toilet models, with the conventional toilet seat mounting bolts passing through the holes and holding the bracket in place.

Figure 2:
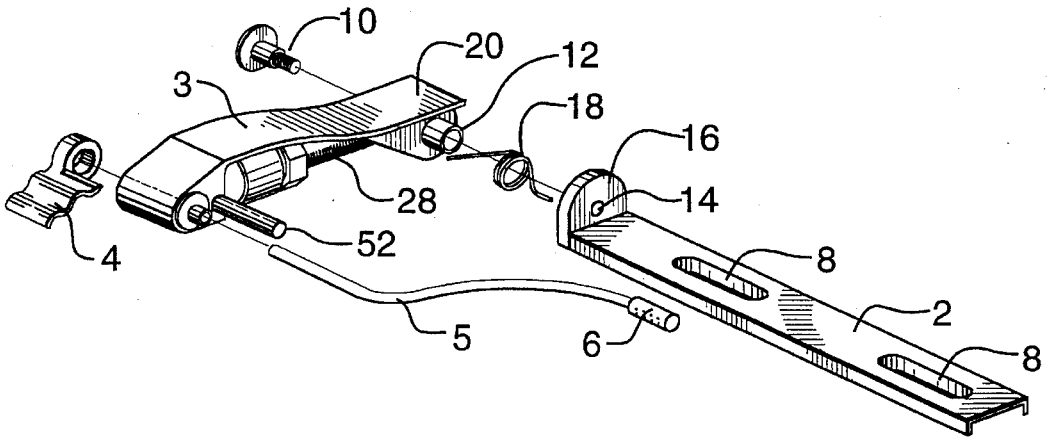
FIG. 2 is an exploded perspective view of the apparatus.

As seen best in FIG. 2, the body 3 is pivotally mounted by virtue of a bolt 10 which passes through a sleeve 12 and is threaded into a hole 14 in an upright portion 16 of the mounting bracket. A spring 18 is mounted between the underside of the mounting bracket, around the sleeve, and against the underside of the upper surface 20 of the body, to supply sufficient force to rotate the body upwardly and rearwardly, to the position shown in FIG. 9, when it is not held down by the weight of the toilet seat 22 or of the toilet seat and lid 23. Obviously, the force of the spring should not be too great, or it will lift the toilet seat, which is not desired.

The body 3 carries a valve assembly 24, which includes a connection 26 to receive a flexible water supply hose 28, which in turn is connected to any desired water supply. On such supply, for example, is a "T" 29 from the regular toilet water supply. The device may be supplied, if desired, with such a "T" as part of the installation kit. Preferably, the "T" assembly includes a separate valve to control the supply of water to the device, so that the water pressure and thus spray force may be independently adjusted.

Figure 3:
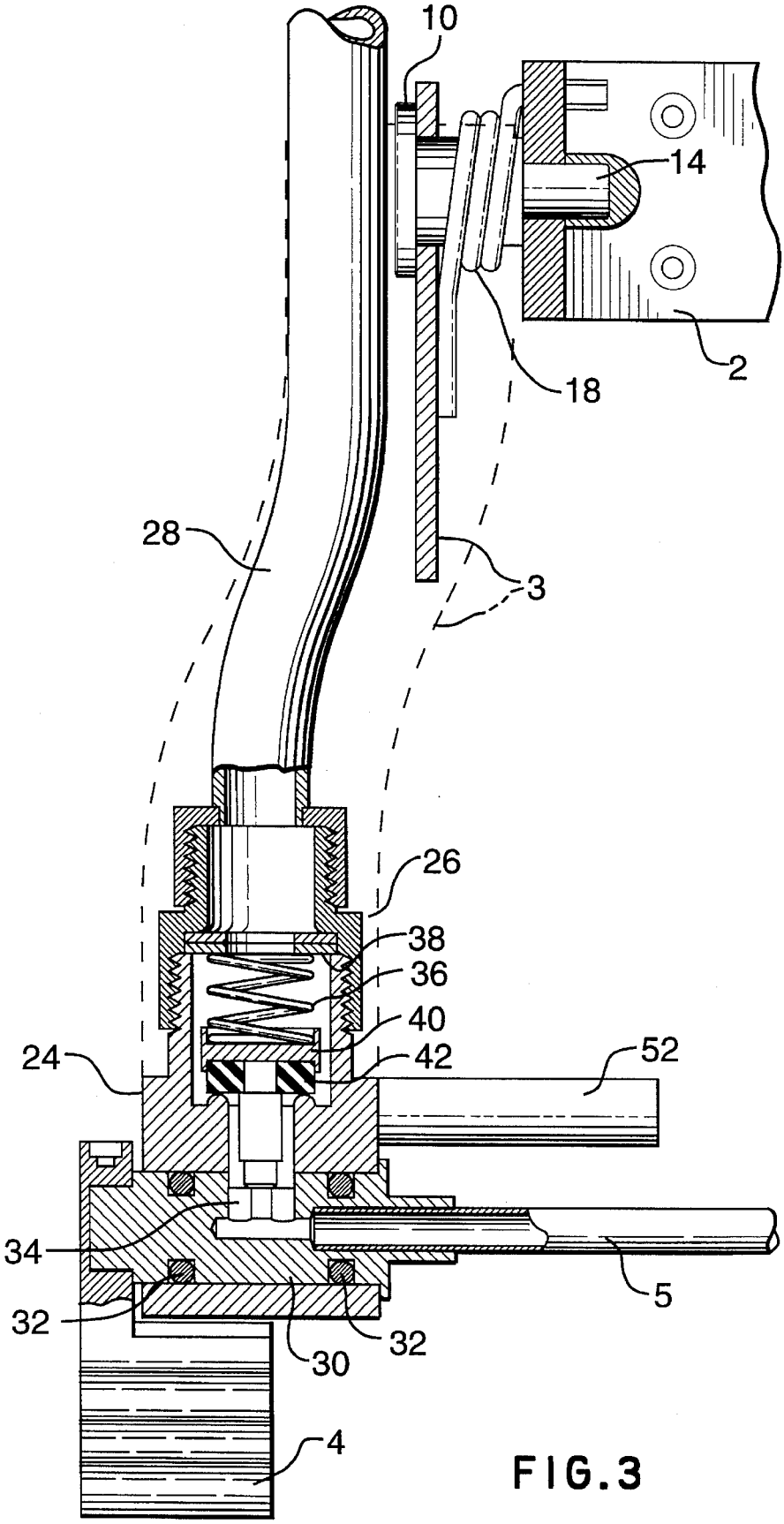
FIG. 3 is a plan view of the main components of the apparatus, in cross-section.

As seen best in FIG. 3, the lever arm 4 is secured to one end of a spool 30, which has the spray arm 5 secured to its other end. The spool rotates in the valve assembly 24, and has two 0-ring seals 32 to prevent leakage. Raising and lowering the lever arm rotates the spool and the spray arm between a retracted or stowed position near the toilet bowl rim and preferably just under the seat, and an operating position as shown in FIG. 1.

Figure 4:
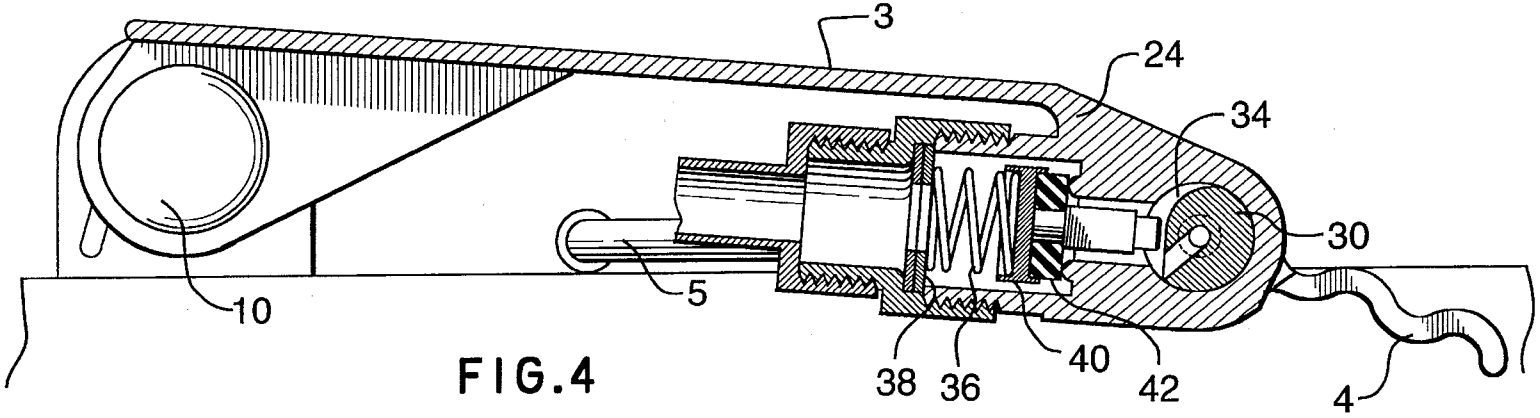
FIG. 4 is a side view, in cross-section, with the valve in the closed position.
Figure 5:
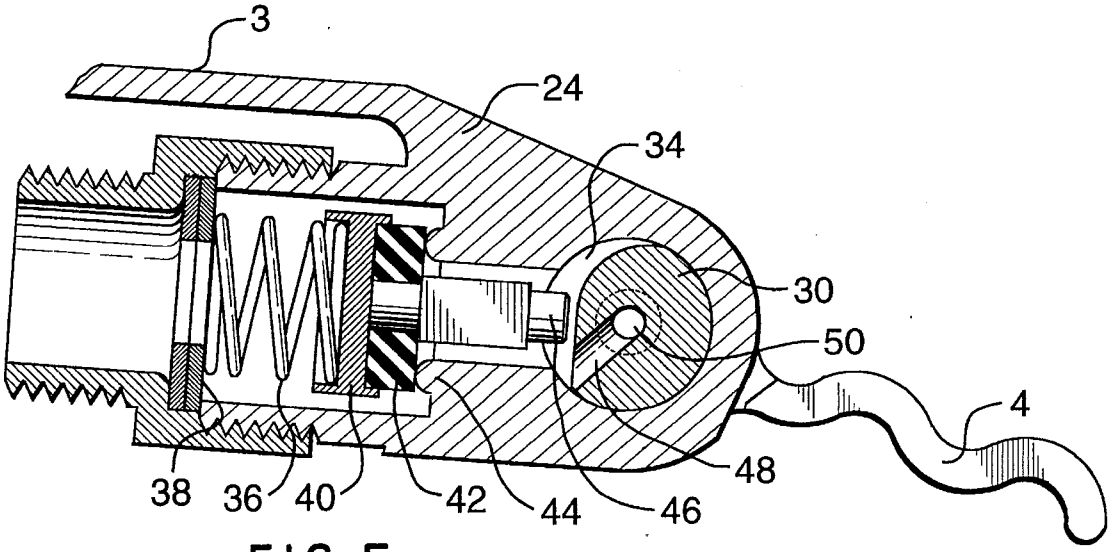
FIG. 5 is a side view, in cross-section, similar to FIG. 4 but focusing on the valve area.
Figure 6:
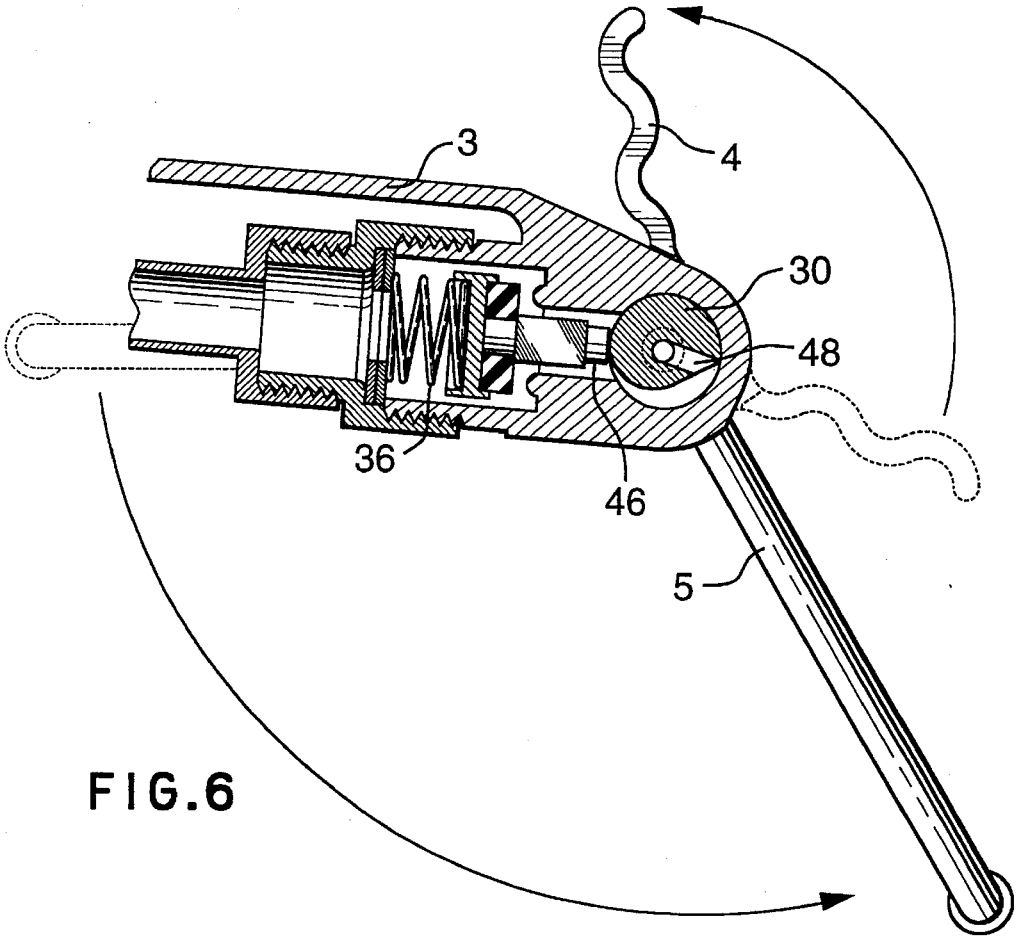
FIG. 6 is a side cross-sectional view, showing rotation of the handle and nozzle arm.
Figure 7:
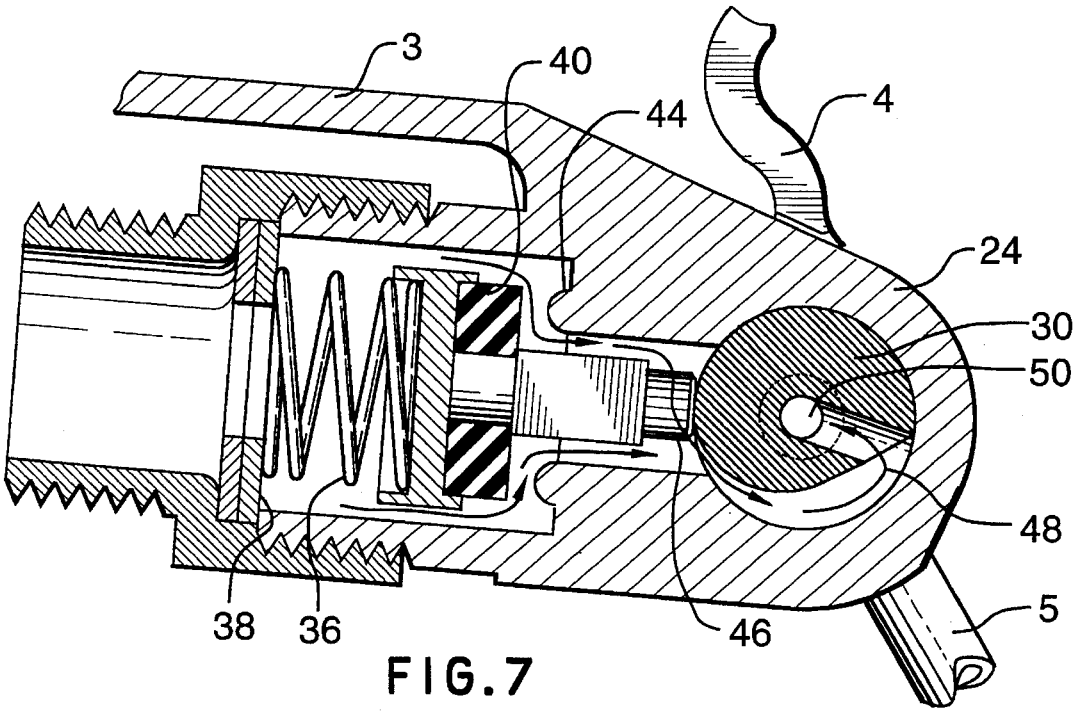
FIG. 7 is a side cross-sectional view, similar to FIG. 6 but focusing on the valve area.

As best seen in FIGS. 4 and 5, the spool 30 includes a central cam portion 34. Normally, water pressure in the supply line, aided by a spring 36 acting between a collar 38 and a seal holder 40, keeps a rubber seal 42 against a seat 44, preventing the flow of water through the valve assembly. However, as seen in FIGS. 6 and 7, when the lever arm is raised to rotate the spool, the cam portion acts against a plunger 46, to force the seal 42 away from the seat 44, thereby allowing a flow of water through the valve assembly. The water flows into the area of the cam portion, then into a radial channel 48 in the cam portion, and then out an axial central bore 50 in the spool, which communicates with the spray arm 5. The 0-ring seals 32 prevent leakage in this lower-pressure condition, but are not called on to act as a seal under line pressure. The seal 42 is the secure seal exposed to line pressure. This lack of reliance on 0-ring seals under line pressure reduces the likelihood of leakage.

As the lever arm is rotated, the spray arm rotates from its stowed position, to the operating position.

Figure 8:
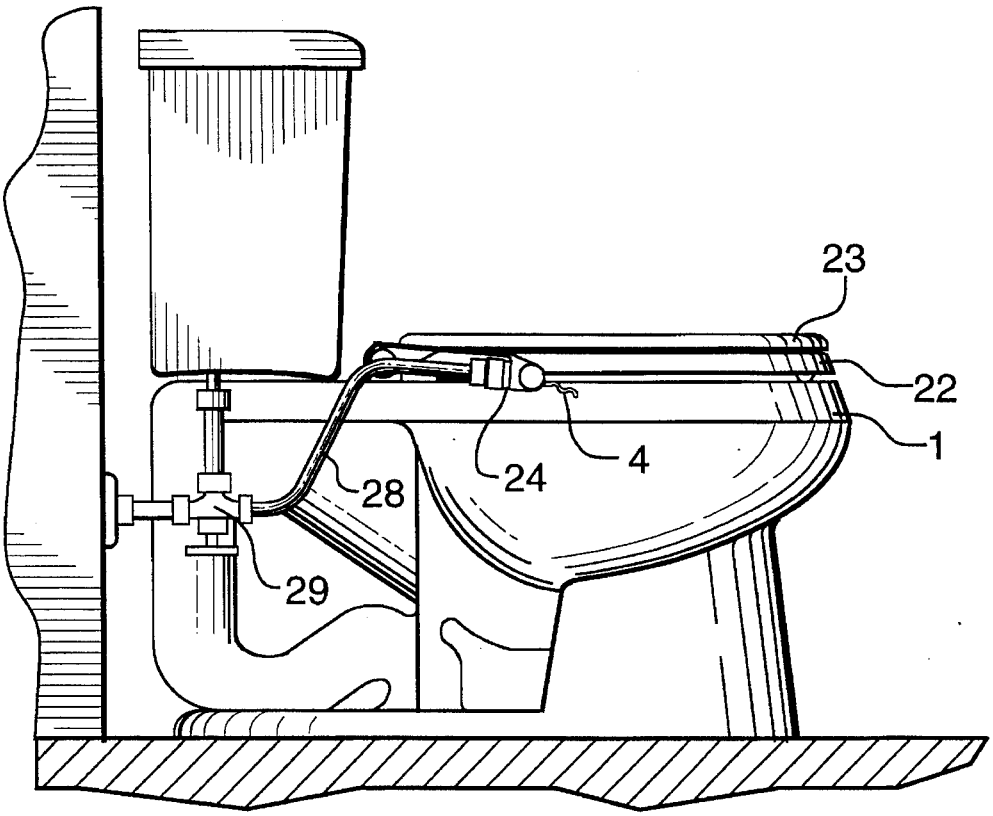
FIG. 8 is a side view of the overall toilet, with the seat down.
Figure 9:
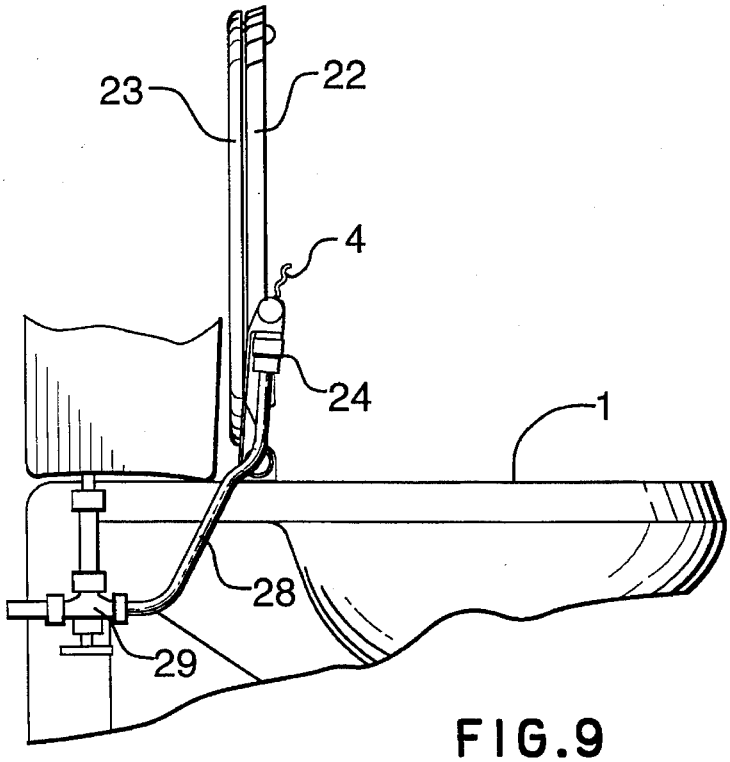
FIG. 9 is a side view of the overall toilet, with the seat up.
Figure 10:
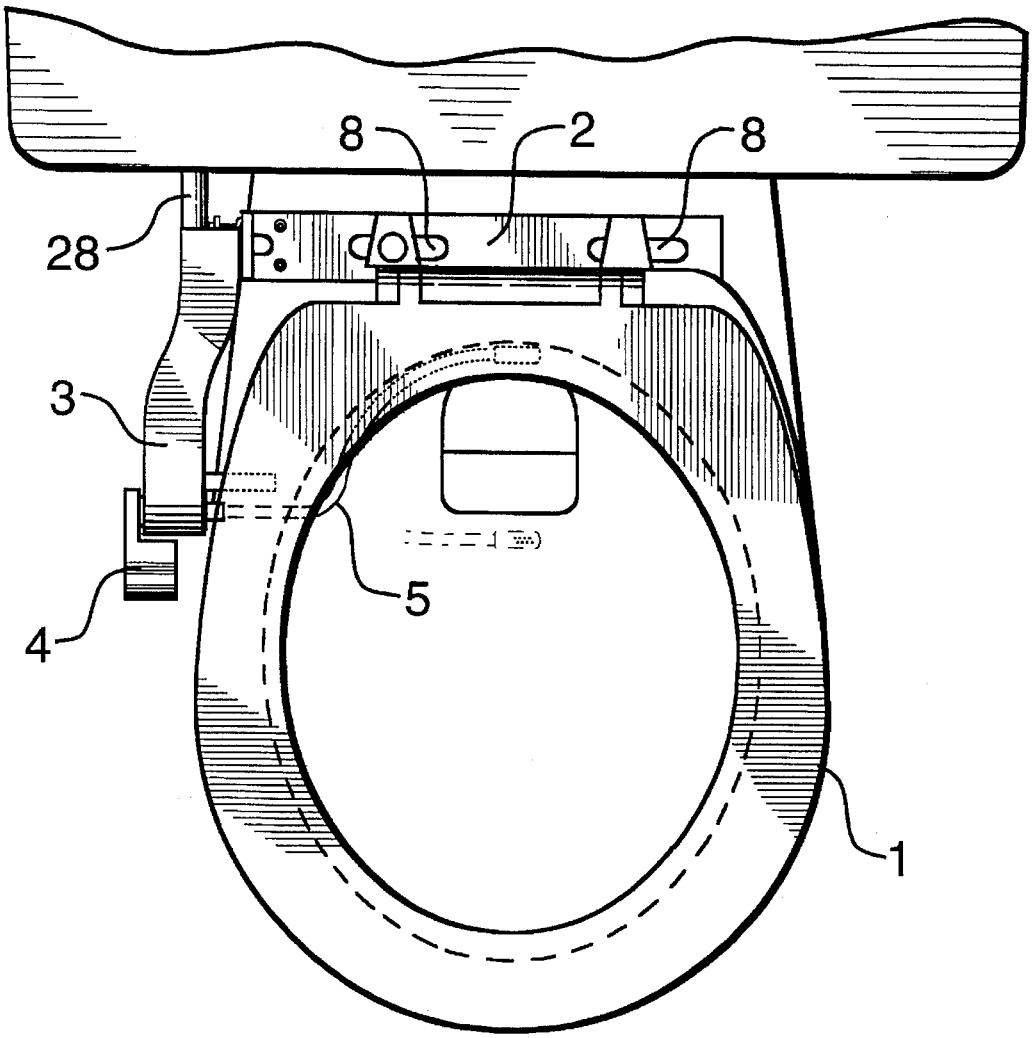
FIG. 10 is a top view of the toilet, with the seat down and the bidet in the retracted position.

As seen in FIGS. 8 and 9, the toilet seat normally holds the overall device down against the rim of the toilet bowl. This is because of the projecting peg 52, seen best in FIGS. 1–3. However, when the toilet seat is raised as shown in FIG. 9, the spring 18, as mentioned previously, causes the device to rotate upwardly with the toilet seat. This is a preferred but not necessarily essential feature of the invention. The peg and the spray arm are the only parts that are between the toilet seat and the toilet bowl. Therefore any lifting of the seat from the bowl is minimal, so installation is simplified. The peg absorbs the weight of a person sitting on the seat, so that the spray arm is not crushed.

The apparatus shown in the accompanying drawings and described below are examples which embody the invention. It should be noted that the scope of the invention is defined by the accompanying claims, and not necessarily by specific features of exemplary embodiments.

What is claimed as the invention is:

1. A bidet device for installation on a toilet bowl, said device comprising:

a mounting bracket securable to the toilet bowl;

a body attached near one of its ends to one end of the mounting bracket, configured to extend partially along a side of the toilet bowl;

a lever arm at the distal end of the body, pivotally connected thereto to pivot between an operating position and a retracted position, said lever arm rotating a spray arm between an operating position where said lever arm is rotating a spray arm between an operating position where said lever arm is generally in a central position within said toilet bowl with a nozzle on the end thereof pointing generally upwardly, and a retracted position where said spray arm is positioned generally adjacent said bowl, said lever arm simultaneously rotating a valve to open said valve in said operating position and close said valve in said retracted position; and a water supply connected to said valve to deliver water to said spray arm and nozzle via said valve, where said body is pivotally attached to said mounting bracket, for rotation about a lateral, horizontal axis, said device further comprising a peg projecting from said body to be located beneath a toilet seat, said device further comprising biasing means positioned to bias said body upwardly, such that when said toilet seat is raised, said biasing means rotates said body upwardly with said toilet seat, and when said toilet seat is lowered, it lowers said body with it by virtue of contact with said peg.

2. A device as recited in claim 1, where said lever arm is secured to one end of a spool, which has the spray arm secured to its other end, said spool rotating in said body rotation of said spool causing a cam to act against a plunger, said plunger forcing a seal away from a valve seat to allow the flow of water through said valve.

* * * * *